US007980166B1

(12) United States Patent
Fuqua et al.

(10) Patent No.: US 7,980,166 B1
(45) Date of Patent: Jul. 19, 2011

(54) BALLISTIC BARRIER

(76) Inventors: Charles L. Fuqua, Woodbridge, VA (US); Steven S. Kahre, Spotsylvania, VA (US)

( * ) Notice: Subject to any disclaimer, the term of this patent is extended or adjusted under 35 U.S.C. 154(b) by 305 days.

(21) Appl. No.: 12/215,836

(22) Filed: Jun. 30, 2008

(51) Int. Cl.
*F41H 7/00* (2006.01)

(52) U.S. Cl. ..... 89/36.07; 86/50

(58) Field of Classification Search ..... 89/36.07, 89/36.01, 920, 926; 86/50
See application file for complete search history.

(56) References Cited

U.S. PATENT DOCUMENTS 5,377,577 A * 1/1995 Bounkong et al. ..... 89/36.05
6,161,462 A 12/2000 Michaelson
6,581,505 B1 * 6/2003 Levell ..... 89/36.07
7,389,718 B1 * 6/2008 Carter et al. ..... 89/36.02
7,424,844 B2 * 9/2008 Carter ..... 89/36.07
7,520,206 B2 * 4/2009 Baker ..... 89/36.06
2006/0011054 A1 * 1/2006 Walthall et al. ..... 86/50
2007/0039639 A1 * 2/2007 Duncan ..... 135/97

* cited by examiner

*Primary Examiner* — J. Woodrow Eldred

(74) *Attorney, Agent, or Firm* — Schwartz Law Firm, P.C.

(57) ABSTRACT

A ballistic barrier incorporates a flexible ballistic blanket having a threat side and a protected side, opposing top and bottom edges, and opposing side edges. A plurality of spaced-apart elongated stiffening elements extend longitudinally between opposing top and bottom edges of the ballistic blanket. An elongated structural brace extends laterally between opposing side edges of the ballistic blanket, and is arranged to support the ballistic blanket in a desired lateral configuration.

14 Claims, 5 Drawing Sheets

BALLISTIC BARRIER

TECHNICAL FIELD AND BACKGROUND

The present disclosure relates broadly and generally to the ballistics industry, and more particularly to a ballistic barrier. The invention may be designed in any given size, shape, and configuration, and for any required threat level (from Level 1 to Level 8) without departing from basic design features and principles disclosed in this specification. The invention may be used alone or in combination with other ballistic elements including, for example, bullet resisting acrylics and bomb blast resistant polymers, such as polycarbonate.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, a ballistic barrier may comprise a flexible ballistic blanket having a threat side and a protected side, opposing top and bottom edges, and opposing side edges. A plurality of spaced-apart elongated stiffening elements extend longitudinally between opposing top and bottom edges of the ballistic blanket. An elongated structural brace extends laterally between opposing side edges of the ballistic blanket, and is arranged to support the ballistic blanket in a desired lateral configuration.

As used herein, the longitudinal dimension of the ballistic blanket refers to that measured from the top edge to the bottom edge of the ballistic blanket. The term "extend (or extending) longitudinally" means extending along a line perpendicular to the top and/or bottom edge of the ballistic blanket, or at any angle (greater than zero) to the top and/or bottom edge.

The lateral dimension of the ballistic blanket refers to a measurement taken across the ballistic blanket from one side edge to the opposite side edge. The term "extend (or extending) laterally" means extending along a line perpendicular to either side edge of the ballistic blanket, or at any angle (greater than zero) to the side edge.

The term "lateral configuration" refers herein to the shape of the ballistic blanket as it extends from one side edge to the other. For example, the lateral configuration may be linear, arcuate, C-shaped, L-shaped, circular, etc.

According to another exemplary embodiment, the stiffening elements comprise a plurality of elongated parallel stiffening rods extending substantially from the top edge of the ballistic blanket to the bottom edge of the ballistic blanket. In one embodiment, the stiffening rods extend at an angle substantially 90-degrees to the top and/or bottom edges of the ballistic blanket. In alternative embodiments, one or more of the stiffening rods may be disposed at any angle other than zero and 90 degrees to the top and/or bottom edges.

According to another exemplary embodiment, the stiffening rods are constructed of a substantially rigid material selected from a group consisting of fiberglass, metal, and plastic. The term "substantially rigid" means having sufficient stiffness to support the ballistic blanket in a substantially spread or extended (e.g., upright) condition from its top edge to its bottom edge.

According to another exemplary embodiment, each of the stiffening rods has a diameter in the range of 0.125 to 1.0 inches—the diameter being substantially uniform and consistent from one end of the rod to the other.

According to another exemplary embodiment, the stiffening rods are laterally spaced-apart a distance of between 4 and 8 inches.

According to another exemplary embodiment, the ballistic blanket includes a plurality of laterally spaced, integrally-formed, longitudinal sleeves receiving and holding respective stiffening rods. In one embodiment, the sleeves entirely encase respective stiffening rods.

According to another exemplary embodiment, each of the sleeves has a releasable end flap. The end flap may be releasably closed using complementary fasteners, such as hook and loop, snaps, buttons, or the like.

According to another exemplary embodiment, a plurality of carry handles are located on the protected side of the ballistic blanket.

According to another exemplary embodiment, the structural brace is removably secured to the protected side of the ballistic blanket.

According to another exemplary embodiment, the structural brace comprises a plurality of articulated sections interconnected in series, and extending collectively from one side edge of the ballistic blanket to the opposing side edge of the ballistic blanket.

According to another exemplary embodiment, the structural brace is located intermediate the top and bottom edges of the ballistic blanket, and extends substantially perpendicular to the stiffening elements.

According to another exemplary embodiment, the ballistic blanket includes a plurality of cooperating, laterally-spaced brace loops receiving and holding the structural brace.

According to another exemplary embodiment, the ballistic blanket is constructed of a fabric including fibers selected from a group consisting of nylon, aramid, polyolefin, and polyethylene.

According to another exemplary embodiment, at least two longitudinally-spaced structural braces are located intermediate the top and bottom edges of the ballistic blanket, and extend laterally between opposing side edges of the ballistic blanket.

According to another exemplary embodiment, the ballistic barrier incorporates less than four longitudinal stiffening elements per linear foot of the ballistic blanket—the blanket being measured from one side edge to the other and in a laterally spread condition.

According to another exemplary embodiment, the ballistic barrier incorporates at least two longitudinal stiffening elements per linear foot of the ballistic blanket—the blanket being measured from one side edge to the other and in a laterally spread condition.

In yet another exemplary embodiment, the disclosure comprises a method for erecting a ballistic barrier at a safety site. The method includes transporting a flexible ballistic blanket in roll-form to the safety site, and then unrolling the ballistic blanket. The ballistic blanket is stiffened longitudinally from a top edge thereof to a bottom edge thereof, braced laterally from one side edge thereof to an opposite side edge thereof. At the safety site, the ballistic blanket may be arranged and supported in any desired lateral configuration. The term "stiffened" (or "stiffening") means to support the ballistic blanket in a substantially spread or extended condition from its top edge to its bottom edge.

According to another exemplary embodiment, the method includes custom configuring a lateral shape of the ballistic blanket at the safety site.

According to another exemplary embodiment, the method includes configuring the ballistic blanket at the safety site in an arcuate lateral shape.

According to another exemplary embodiment, the method includes relocating the ballistic barrier using handles attached to a protected side of the ballistic blanket.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
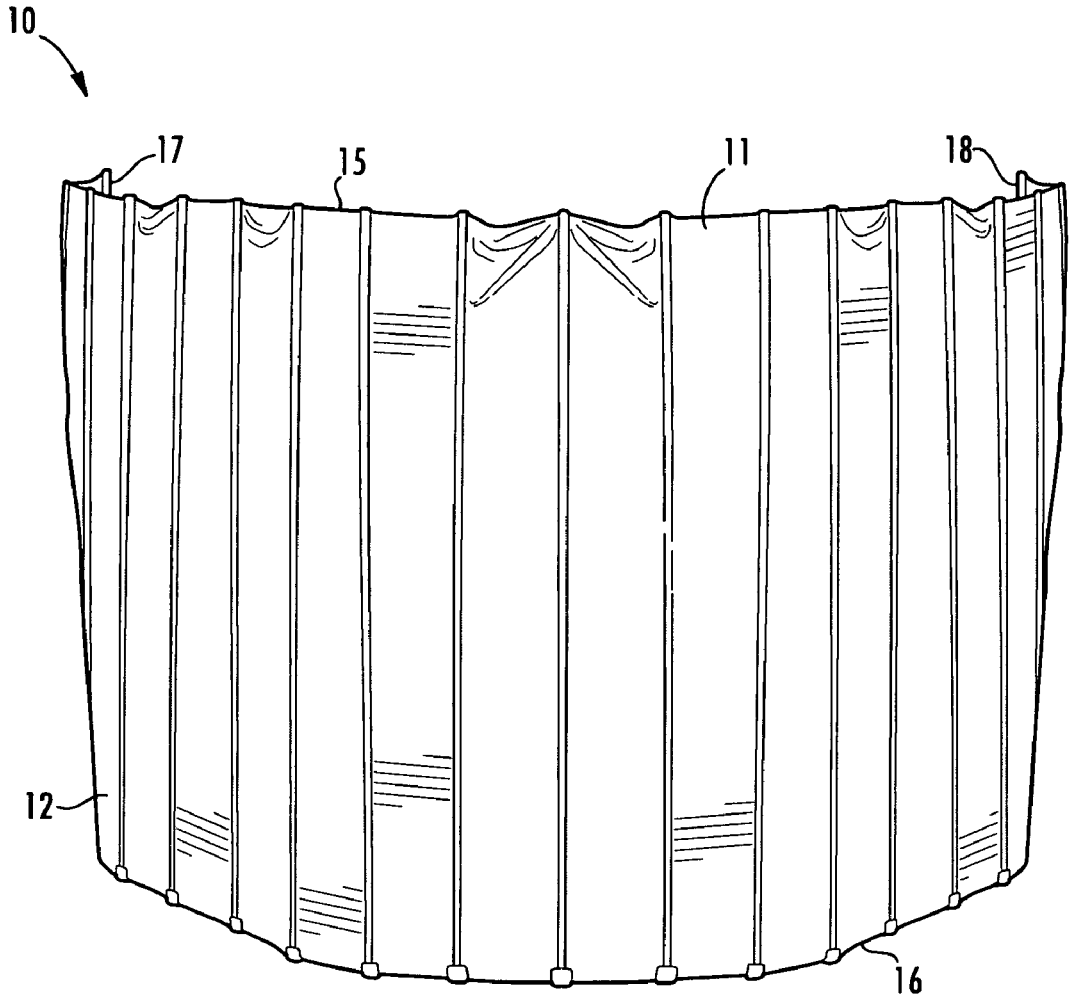
FIG. 1 is a threat-side perspective view of a ballistic barrier according to one exemplary embodiment of the present disclosure.
Figure 2:
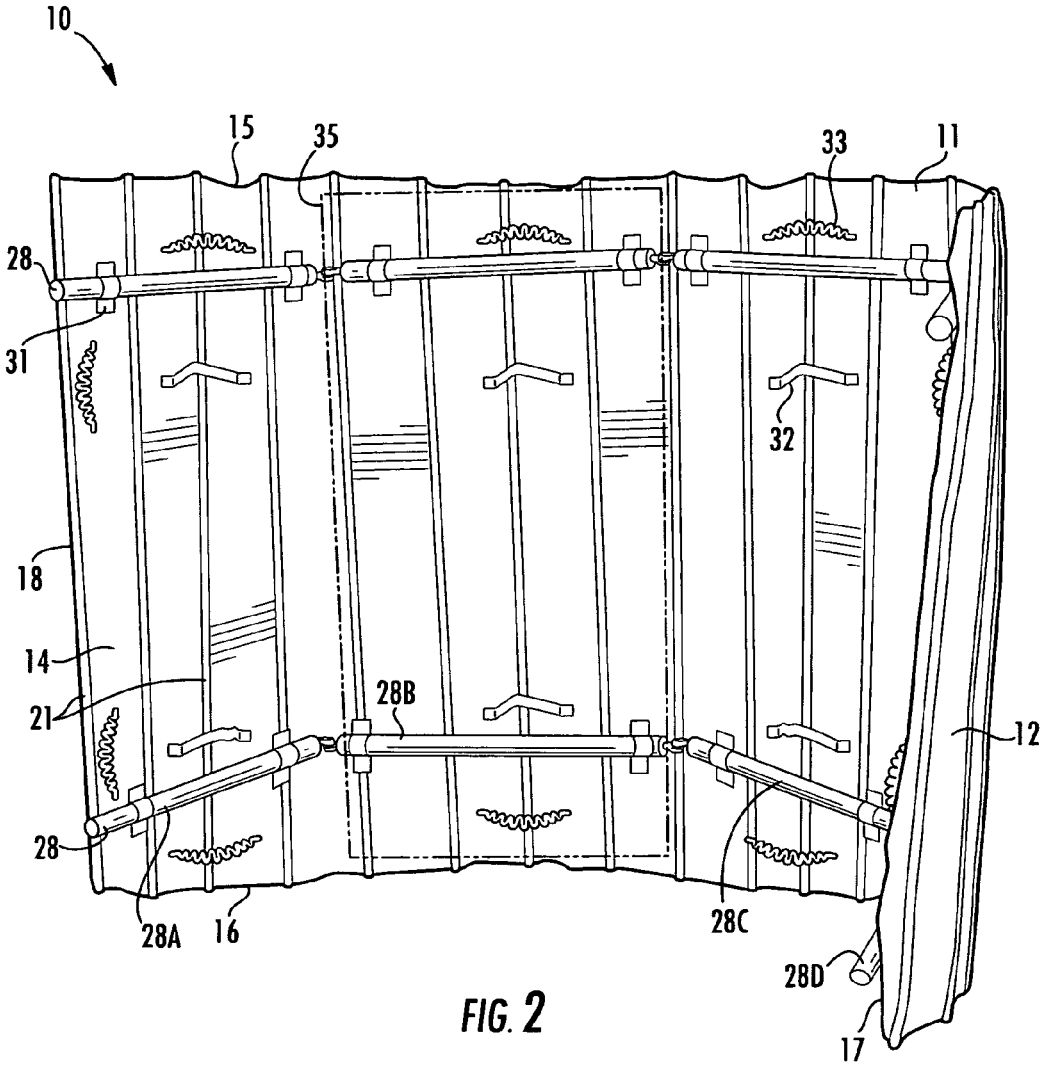
FIG. 2 is a further perspective view of the ballistic barrier from its protected side.

Referring now specifically to the drawings, a ballistic barrier according to one exemplary embodiment of the present invention is illustrated in FIGS. 1 and 2, and shown generally at reference numeral 10. The exemplary ballistic barrier 10 incorporates a flexible ballistic blanket 11 having a threat side 12 (FIG. 1) and a protected side 14 (FIG. 2), opposing top and bottom edges 15, 16, and opposing side edges 17, 18. The ballistic blanket 11 may be constructed a soft knit, woven or nonwoven fabric, and may incorporate high tensile strength fibers such as nylon, aramid, polyolefin, and polyethylene. For example, the ballistic blanket 11 may comprise an outer cover or shell constructed of a ballistic fabric, such as that manufactured by Invista North America under the brand name CORDURA®, and including one or multiple layers or panels of soft or hard armor material encased inside the shell. In the example shown, when laid flat (or fully spread) the ballistic blanket 11 has a generally rectangular shape, and an exemplary dimension of approximately 50-inches measured from the top edge 15 to the bottom edge 16, and approximately 96-inches measured from one side edge 17 to the other side edge 18.

Figure 3:
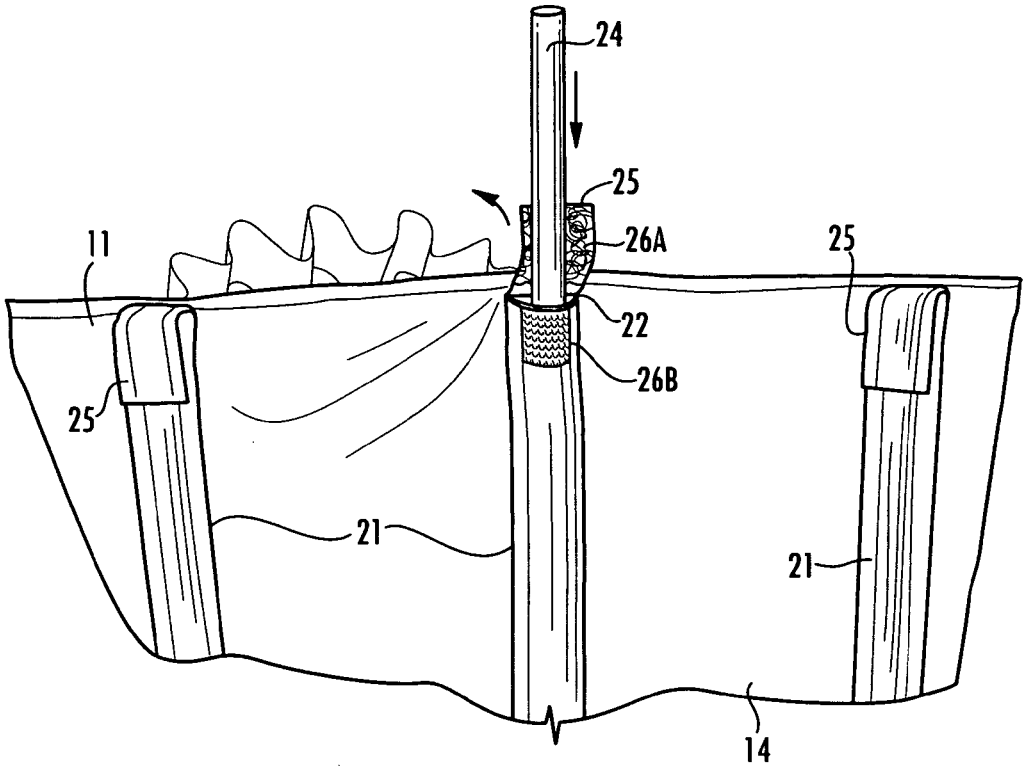
FIG. 3 is an enlarged, fragmentary view of the ballistic barrier demonstrating insertion of a stiffening rod inside a longitudinal sleeve of the ballistic blanket.

As best shown in FIGS. 1 and 3, a laterally-spaced series of parallel sleeves 21 are integrally-formed with the ballistic blanket 11 on its threat side 12, and have respective openings 22 at either top or bottom ends designed to receive elongated stiffening rods 24—the opposite top or bottom ends of the sleeves 21 being closed. The sleeves 21 may be joined to the blanket by sewing, or other suitable attachment means, and may comprise respective releasably-closeable end flaps 25 adjacent the open ends 22. The end flaps 25 may be releasable closed using, for example, complementary hook and loop fasteners 26A, 26B, or snaps, buttons, or the like. In one embodiment, the sleeves 21 extend longitudinally between, and substantially perpendicular to, the top and bottom edges 15, 16 of the ballistic blanket 11, and are laterally spaced apart a distance of between 4 and 8 inches between opposing side edges 17 and 18.

The parallel stiffening rods 24 are inserted into respective sleeves 21 (at 4 to 8-inch lateral spacing), and are constructed of a substantially rigid material, such as fiberglass, metal or plastic, having a diameter in the range of 0.125 to 1.0 inches. The stiffening rods 24 may be inserted in all or less than all of the sleeves 21, as needed for adequate longitudinal stiffness.

Figure 4:
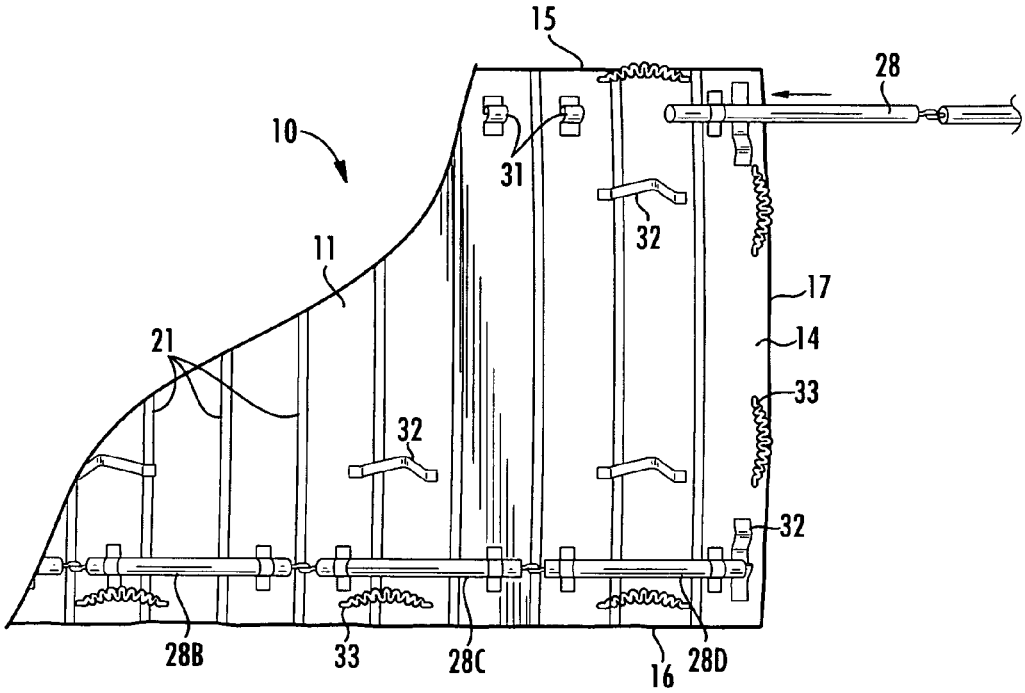
FIG. 4 is a fragmentary view of the ballistic barrier demonstrating insertion of a structural brace through brace loops on the protected side of the ballistic blanket.
Figure 5:
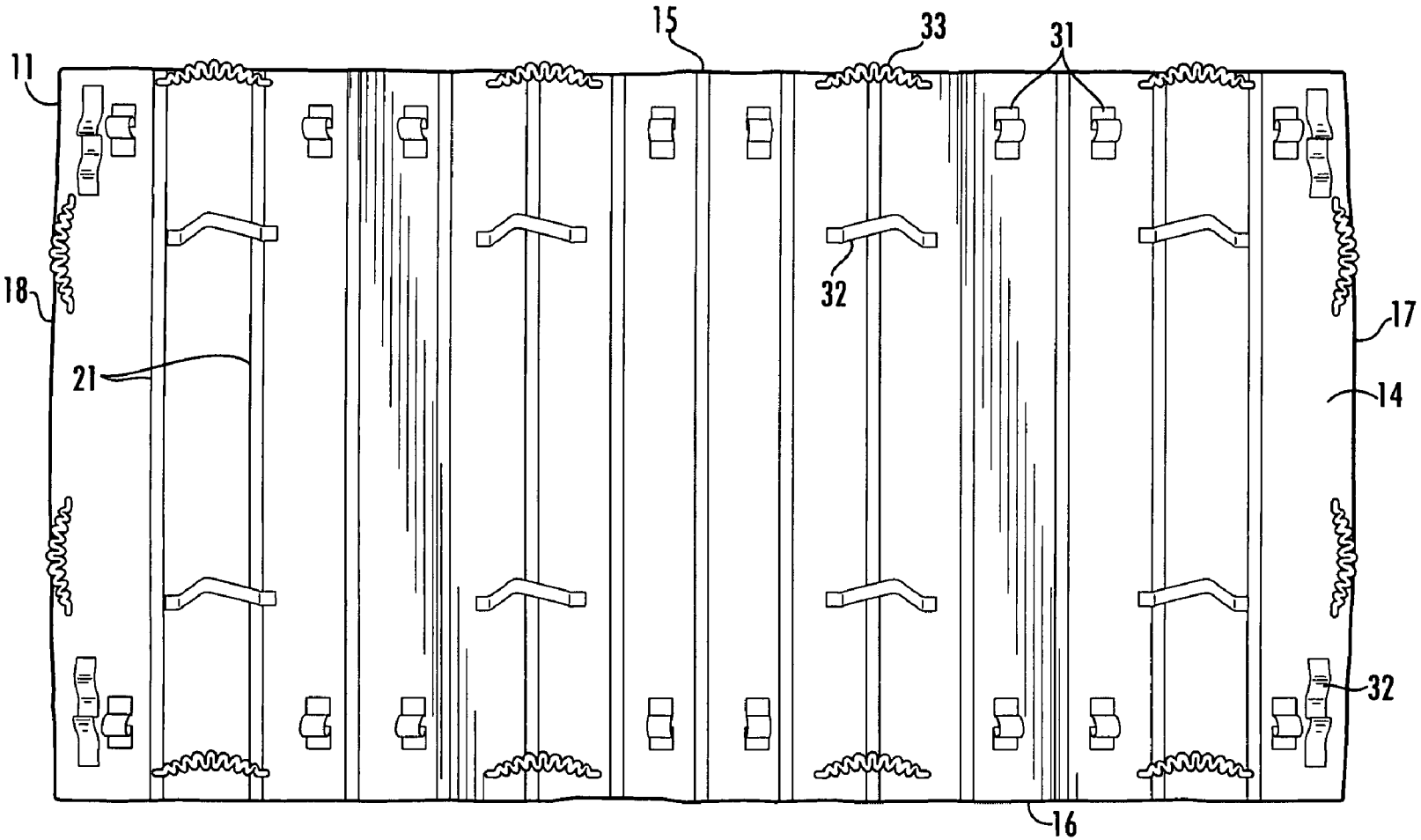
FIG. 5 is view showing the protected side of the ballistic blanket laid flat.

As best shown in FIGS. 2 and 4, a pair of identical articulated structural braces 28 extend laterally between opposing side edges 17, 18 of the ballistic blanket 11 on the protected side 14, and may be custom arranged to support the ballistic blanket 11 in a desired lateral configuration. For example, FIGS. 1 and 2 show the ballistic blanket 11 arranged in a self-supporting arcuate or substantially C-shaped lateral configuration. Each brace 28 comprises a number of identical articulated sections 28A, 28B, 28C, and 28D pivotably interconnected in series, and extending collectively from one side edge 17 of the ballistic blanket 11 to the opposite side edge 18 of the ballistic blanket 11. In the exemplary embodiment, the braces 28 are constructed of hinged metal pipe with respective hinge points located in precise vertical alignment. Alternatively, each brace 28 may comprise a single straight or curved section of pipe or other rigid structure. The braces 28 reside intermediate the top and bottom edges 15, 16 of the ballistic blanket 11, and may be removably secured to the blanket 11 using cooperating fabric loops 31 sewn to the protected side 14. Additionally, as shown in FIGS. 2 and 5, the ballistic barrier 10 may have a number of carry handles 32, 33 sewn to ballistic blanket 11 on its protected side 14. Multiple handles 32, 33 may be provided in respective barrier zones defined by articulated sections 28A-28D of the braces 28, such that the braces 28 may be readily adjusted from the protected side 14 of the ballistic blanket 11. For example, the area indicated at 35 comprises a barrier zone defined by the articulated brace section 28B.

To facilitate storage and transport of the ballistic barrier 10, the structural braces 28 may be removed from the brace loops 31 and the flexible blanket 11 rolled or folded into a tight, compact package. The rolled blanket 11 and (folded) braces 28 may then be placed inside a convenient carry case (not shown) for transport. To setup the ballistic barrier 10, the carry case is transported to a desired safety site where the ballistic blanket 11 is unrolled and laid flat on its threat side 12. The structural braces 28 are then inserted through the brace loops 31, and the ballistic blanket 11 lifted and stood vertically. In this position, the articulated braces 28 may then be pivoted to custom configure the ballistic barrier 10 in any desired lateral shape. Depending upon the selected configuration, no additional support structure or bracing may be needed. Once configured, the ballistic barrier 10 may rest directly (e.g., self-supported) on the ground, or may be located on a counter or other elevated surface.

In a smaller size embodiment, the ballistic barrier 10 may be used as a protective shield designed for carrying by a user. In still other exemplary implementations, the ballistic barrier 10 may be suspended from other structure and used as a protective curtain or wall, or assembled together with other barriers in a vertical offset design or butted design (with baffles) to form an anti-ballistic enclosure.

Exemplary embodiments of the present invention are described above. No element, act, or instruction used in this description should be construed as important, necessary, critical, or essential to the invention unless explicitly described as such. Although only a view of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

We claim:

1. A ballistic barrier, comprising:

a flexible ballistic blanket having a threat side and a protected side, opposing top and bottom edges, and opposing side edges; and said ballistic blanket comprising a plurality of laterally spaced, integrally-formed, longitudinal sleeves;

a plurality of spaced-apart elongated stiffening elements extending longitudinally between opposing top and bottom edges of said ballistic blanket, wherein said stiffening elements comprise a plurality of elongated parallel stiffening rods received within respective longitudinal sleeves and extending substantially from the top edge of said ballistic blanket to the bottom edge of said ballistic blanket; and an elongated structural brace extending laterally between opposing side edges of said ballistic blanket, and arranged to support said ballistic blanket in a desired lateral configuration.

2. A ballistic barrier according to claim 1, wherein said stiffening rods are constructed of a substantially rigid material selected from a group consisting of fiberglass, metal, and plastic.

3. A ballistic barrier according to claim 1, wherein each of said stiffening rods has a diameter in the range of 0.125 to 1.0 inches.

4. A ballistic barrier according to claim 1, wherein said stiffening rods are laterally spaced-apart a distance of between 4 and 8 inches.

5. A ballistic barrier according to claim 1, wherein each of said sleeves comprises a releasable end flap.

6. A ballistic barrier according to claim 1, and comprising a plurality of carry handles located on the protected side of said ballistic blanket.

7. A ballistic barrier according to claim 1, wherein said structural brace is removably secured to the protected side of said ballistic blanket.

8. A ballistic barrier according to claim 7, wherein said structural brace comprises a plurality of articulated sections interconnected in series, and extending collectively from one side edge of said ballistic blanket to the opposing side edge of said ballistic blanket.

9. A ballistic barrier according to claim 8, wherein said structural brace is located intermediate the top and bottom edges of said ballistic blanket, and extends substantially perpendicular to said stiffening elements.

10. A ballistic barrier according to claim 9, wherein said ballistic blanket comprises a plurality of cooperating, laterally-spaced brace loops receiving and holding said structural brace.

11. A ballistic barrier according to claim 1, wherein said ballistic blanket comprises a fabric including fibers selected from a group consisting of nylon, aramid, polyolefin, and polyethylene.

12. A ballistic barrier according to claim 1, and comprising at least two longitudinally-spaced structural braces located intermediate the top and bottom edges of said ballistic blanket, and extending laterally between opposing side edges of said ballistic blanket.

13. A ballistic barrier according to claim 1, and comprising less than four elongated stiffening elements per linear foot of said ballistic blanket.

14. A ballistic barrier according to claim 1, and comprising at least two elongated stiffening elements per linear foot of said ballistic blanket.

* * * * *